US006175699B1

(12) United States Patent
Kato et al.

(10) Patent No.: US 6,175,699 B1
(45) Date of Patent: Jan. 16, 2001

(54) IMAGE FIXING DEVICE WITH HEATER CONTROL

(75) Inventors: Akira Kato, Toride; Yasumasa Otsuka, Yokohama; Yoji Tomoyuki, Ichikawa; Akira Hayakawa, Abiko; Daizo Fukuzawa, Matsudo; Mahito Yoshioka; Masahide Hirai, both of Toride; Ken Nakagawa, Moriya; Hisashi Nakahara, Toride, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/317,161

(22) Filed: May 24, 1999

(30) Foreign Application Priority Data

May 29, 1998 (JP) ..... 10-150397
Jun. 8, 1998 (JP) ..... 10-159680
Oct. 30, 1998 (JP) ..... 10-298156

(51) Int. Cl.[7] ..... G03G 15/00
(52) U.S. Cl. ..... 399/69; 399/70
(58) Field of Search ..... 399/69, 70, 324; 219/216

(56) References Cited

U.S. PATENT DOCUMENTS 4,627,714 * 12/1986 Nozaki ..... 219/216 X
5,109,255 * 4/1992 Nishikawa et al. ..... 219/216 X
5,253,024 10/1993 Okuda et al. .
5,436,709 * 7/1995 Sakaizawa et al. ..... 219/216 X
5,489,761 * 2/1996 Aslam et al. ..... 219/216
5,552,874 9/1996 Ohtsuka et al. .
5,801,360 9/1998 Oba et al. ..... 219/216
5,832,332 * 11/1998 Sugiura ..... 399/69 X

FOREIGN PATENT DOCUMENTS 63-313182 12/1988 (JP) .
1-263679 10/1989 (JP) .
2-157878 6/1990 (JP) .
4-044075 2/1992 (JP) .
4-044076 2/1992 (JP) .
4-044077 2/1992 (JP) .
4-044078 2/1992 (JP) .
4-044079 2/1992 (JP) .
4-044080 2/1992 (JP) .
4-044081 2/1992 (JP) .
4-044082 2/1992 (JP) .
4-044083 2/1992 (JP) .
4-204980 7/1992 (JP) .
4-204981 7/1992 (JP) .
4-204982 7/1992 (JP) .
4-204983 7/1992 (JP) .
4-204984 7/1992 (JP) .
4-204985 7/1992 (JP) .
4-204986 7/1992 (JP) .
4-204987 7/1992 (JP) .
4-204988 7/1992 (JP) .
4-204989 7/1992 (JP) .
5-289562 11/1993 (JP) .
6-242700 9/1994 (JP) .
7-248700 9/1995 (JP) .

* cited by examiner

*Primary Examiner*—William J. Royer
(74) *Attorney, Agent, or Firm*—Fitzpatrick, Cella, Harper & Scinto

(57) ABSTRACT

An image fixing apparatus has a heating member, a back-up roller cooperating with the heating member to form a nip therebetween for pinching and conveying a recording material bearing an image thereon, and a controlling device for controlling a temperature of the nip. The controlling device heats the nip after a fixing process is finished and after a rotation of the back-up roller is stopped.

18 Claims, 12 Drawing Sheets

CONTROL IN WAITING

FIG. 19

| INITIAL TEMPERATURE OF FIXING DEVICE | TEMPERATURE IN POST-ROTATION |
|---|---|
| TO 50 °C | 200 °C |
| 50 °C TO 75 °C | 195 °C |
| 75 °C TO 105 °C | 190 °C |
| 105 °C TO 120 °C | 185 °C |
| FROM 120 °C | 180 °C |

IMAGE FIXING DEVICE WITH HEATER CONTROL

BACKGROUND OF THE INVENTION

1. Field of the Invention

The present invention relates to a fixing apparatus used with an image forming apparatus such as a copying machine, a laser printer, a facsimile and the like.

2. Related Background Art

For example, among fixing apparatuses used with an image forming apparatus such as a copying machine, a laser printer, a facsimile and the like, there is a fixing apparatus of heat roller type.

Such a fixing apparatus of heat roller type includes a heat roller (fixing roller) heated by an internal heat source such as a halogen heater to be maintained to a predetermined temperature, and a pressing roller having elasticity and urged against the heat roller. A recording material is introduced into a nip (fixing nip portion) between the heat roller and the pressing roller to be pinched therebetween and to be conveyed, thereby thermally fixing a non-fixed toner image to the recording material.

Recently, there have been proposed thermal fixing apparatuses of film heating type (for example, refer to Japanese Patent Application Laid-open Nos. 63-313182, 1-263679, 2-157878, 4-44075 to 4-44083 and 4-204980 to 4-204989.

The thermal fixing apparatuses of film heating type generally includes a heating body secured to a support member, a heat-resistive film rotating while contacting with the heating body, and a pressing roller cooperating with the heating body to form a nip therebetween with the interposition of the film. By pinching and conveying a recording material bearing a toner image thereon by the nip, the toner image is thermally fixed to the recording material.

The thermal fixing apparatuses of film heating type not only is utilized as an apparatus for thermally fixing a non-fixed toner image to a surface of the recording material to form a permanently fixed image but also is widely used as an apparatus for heating the recording material bearing the toner image thereon to improve a surface feature of the recording material, an apparatus for effecting a pre-fixing process, an apparatus for effecting a sheet heating process, and other apparatuses.

In thermal fixing apparatuses of film heating type, as the heating body, a heater having low heat capacity and capable of being quickly heated, for example a so-called ceramic heater comprised of a ceramic substrate having good insulating and heat conducting ability, and a resistance heat generating layer provided on the substrate and adapted to generate eat by energization can be used. Further, since a thin film material having low heat capacity can be used as the film, a temperature of the heating body can be increased for a short time, with the result that it is not required for supplying an electric power in a stand-by condition. Accordingly, even when a recording material to be heated is immediately introduced into the fixing apparatus, the heating body can sufficiently be heated up to a predetermined temperature before the recording sheet reaches the fixing nip portion, thereby reducing a wait time (achieving quick-start ability and on demand operation), saving the electric power and suppressing increase in temperature of the interior of a main body of the image forming apparatus.

It is ideal that the non-fixed toner image born on the surface of the recording material is moderately heated and melted all over and is fixed to the recording material.

However, if there is cold offset toner (not adequately melted) or hot offset toner (excessively melted), such toner will be transferred to the fixing roller and the fixing film which are contacted with the surface of the recording material.

When the temperatures of upper and lower rotary members are the same, the offset toner is transferred to one of the rotary members which has poor mold releasing ability. On the other hand, when the temperatures of the upper and lower rotary members are different from each other, the offset toner is apt to be transferred to the rotary member having lower temperature because the toner is solidified on the lower temperature rotary member more easily. Particularly in the fixing apparatus having low heat capacity such as the film heating type, since the heating body is not energized in the print waiting (stand-by) condition, the pressing roller is in a cold condition. Accordingly, when the print is started from this condition, although the heating body and the film are heated by energization, since the pressing roller is still cold. In this condition, when the film and the pressure roller are rotated, the toner pinched by the nip is transferred to the pressing roller. If such toner is accumulated, hardness and/or mold releasing ability of the rotary member are changed to affect a bad influence upon the fixing ability.

SUMMARY OF THE INVENTION

The present invention aims to eliminate the above-mentioned conventional drawbacks, and an object of the present invention is to provide an image fixing apparatus which can maintain fixing ability for a long term.

Another object of the present invention is to provide an image fixing apparatus which can suppress accumulation of toner on a pressing roller.

The other objects and features of the present invention will be apparent from the following detailed explanation referring to the accompanying drawings.

BRIEF DESCRIPTION OF THE DRAWINGS

FIG. 19 is a view showing a relationship between a temperature of a fixing rotary member and a temperature in post-heating upon start of print.

DESCRIPTION OF THE PREFERRED EMBODIMENTS

The present invention will now be explained in connection with embodiments thereof with reference to the accompanying drawings.

First Embodiment

Figure 1:
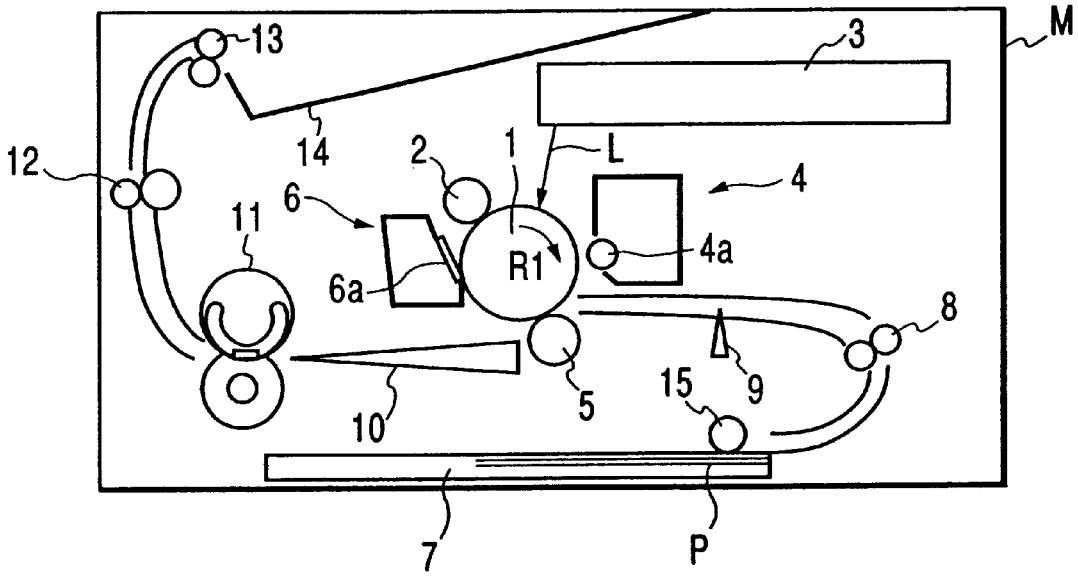
FIG. 1 is a schematic elevational sectional view of an image forming apparatus according to the present invention.

FIG. 1 shows an image forming apparatus having a fixing apparatus according to the present invention. Incidentally, FIG. 1 is a schematic elevational sectional view of a laser beam printer as an example of the image forming apparatus according to the present invention.

First of all, a construction of the laser beam printer (referred to as "image forming apparatus" hereinafter) will be described with reference to FIG. 1.

The laser beam printer shown in FIG. 1 includes a drum-shaped electrophotographic photosensitive body (referred to as "photosensitive drum" hereinafter) 1 as an image bearing member. The photosensitive drum 1 is rotatably supported by a main body M of the image forming apparatus and is rotated at a predetermined process speed in a direction shown by the arrow R1 by means of a driving means (not shown).

Around the photosensitive drum 1, there are disposed, in order along a rotational direction thereof, a charging roller (charging device) 2, an exposure means 3, a developing device 4, a transfer roller (transfer device) 5 and a cleaning device 6.

At a lower part of the main body M, there is disposed a sheet supply cassette 7 containing sheet-shaped recording materials P such as paper sheets, and, in a recording sheet convey path, in order from an upstream side toward a downstream side, there are disposed a sheet supply roller 15, a pair of convey rollers 8, a top sensor 9, a convey guide 10, a fixing apparatus 11 according to the present invention, a pair of convey rollers 12, a pair of discharge rollers 13 and a sheet discharge tray 14.

Next, an operation of the image forming apparatus having the above-mentioned construction will be described.

The photosensitive drum 1 rotated in the direction R1 by the driving means (not shown) is uniformly charged with predetermined polarity and predetermined potential by means of the charging roller 2.

The charged photosensitive drum 1 is subjected to image exposure L by the exposure means 3 such as a laser optical system on the basis of image information, with the result that charges are removed from the exposed area, thereby forming an electrostatic latent image.

The electrostatic latent image is developed by the developing device 4. The developing device 4 has a developing roller 4*a*. By applying developing bias to the developing roller 4*a*, toner is adhered to the electrostatic latent image on the photosensitive drum 1, thereby developing (visualizing) the latent image as a toner image.

The toner image is transferred onto the recording material P such as a paper sheet by the transfer roller 5. The recording material P is contained in the sheet supply cassette 7, is supplied by the sheet supply roller 15 and is conveyed by the pair of convey rollers 8. Then, the recording sheet is passed through the top sensor 9 and is introduced into a transfer nip between the photosensitive drum 1 and the transfer roller 5. In this case, a leading end of the recording material P is detected by the top sensor 9, thereby synchronizing the conveyance of the recording material with the toner image on the photosensitive drum 1. By applying transfer bias to the transfer roller 5, the toner image on the photosensitive drum 1 is transferred onto the recording material at a predetermined position thereon.

The recording material P on which the non-fixed toner image is born is conveyed, along the convey guide 10, to the fixing apparatus 11, where the non-fixed toner image is heated and pressurized and is fixed to the surface of the recording material P. Incidentally, the fixing apparatus 11 will be described later fully.

After the fixing, the recording material P is conveyed by the pair of convey rollers 12 and is discharged onto the sheet discharge tray 14 formed on the upper surface of the main body M by the pair of discharge rollers 13.

On the other hand, after the toner image was transferred, toner (not transferred to the recording material P) remaining on the surface of the photosensitive drum 1 (such toner is referred to as "transfer residual toner" hereinafter) is removed by a cleaning blade 6*a* of the cleaning device 6, and the removed toner is used for later image formation.

By repeating the above-mentioned operations, continuous image formation can be performed.

Figure 2:
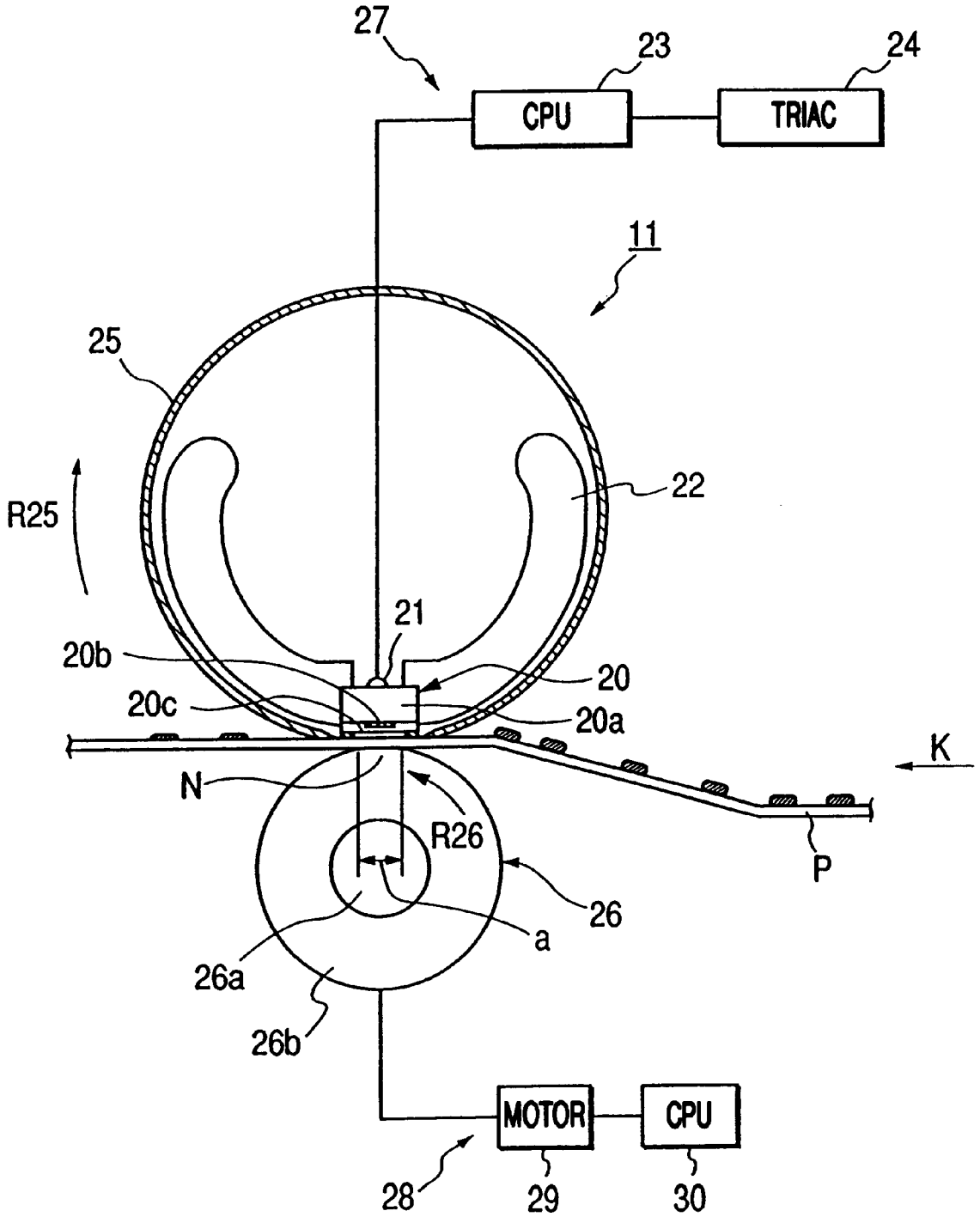
FIG. 2 is a schematic elevational sectional view of a fixing apparatus according to the present invention.

Next, an example of the fixing apparatus or device 11 according to the present invention will be fully described with reference to FIG. 2. FIG. 2 is an elevational sectional view along the recording material P conveying direction (shown by the arrow K).

The fixing device 11 shown in FIG. 2 mainly includes a ceramic heater (referred to merely as "heater" hereinafter) 20 as a heating body for heating the toner, a fixing film (fixing rotary member) 25 enclosing the ceramic heater 20, a pressing roller (another rotary member) 26 urged against the fixing film 25, a temperature controlling means 27 for controlling a temperature of the ceramic heater 20, and a rotation controlling means 28 for controlling conveyance of the recording material P.

The ceramic heater 20 is constituted by forming a resistance pattern 20*b* on a heat-resistive substrate 20*a* made of alumina, for example, by printing and by coating a glass layer 20*c* on the patterned surface and is elongated in a left-and-right direction perpendicular to the recording material P conveying direction (shown by the arrow K) (i.e., longer than the width of the recording material P). The ceramic heater 20 is supported by a heater holder 22 attached to the main body M. The heater holder 22 is formed from a circular heat-resistive resin member and also acts as a guide member for guiding rotation of the fixing film 25 which will be described later.

The fixing film 25 is formed from a cylindrical heat-resistive resin (for example, polyimide) member and is freely or loosely fitted on the ceramic heater 20 and the heater holder 22. The fixing film 25 is urged against the ceramic heater 20 by the pressing roller 26 (described later) so that the rear surface of the fixing film 25 abuts against the lower surface of the ceramic heater 20. The fixing film 25 is rotated in a direction shown by the arrow R25 as the recording material P is conveyed in the direction shown by the arrow K by the rotation of the pressing roller 26 in a direction shown by the arrow R26. Left and right edges of the fixing film 25 are regulated by guide portions (not shown) of the heater holder 22 so that the fixing film is not dislodged along the longitudinal direction of the ceramic heater 20. Further, grease is coated on an inner surface of the fixing film 25 to reduce sliding resistance between the film and the ceramic heater 20 and the heater holder 22.

The pressing roller 26 is constituted by providing a heat-resistive mold releasing layer 26*b* on an outer peripheral surface of a metallic core 26*a*. The fixing film 25 is urged against the ceramic heater 20 from below by a peripheral surface of the mold releasing layer 26*b* to form a fixing nip portion N between the fixing film 25 and the pressing roller 26. A width (nip width) a (in the rotational direction) of the pressing roller 26 in the fixing nip portion N is selected to suitably heat and pressurize the toner on the recording material P.

The rotation controlling means 28 includes a motor 29 for rotating the pressing roller 26 and a CPU 30 for controlling a rotation of the motor 29. For example, a stepping motor is used as the motor 29 so that the pressing roller 26 can be continuously rotated in the direction R26 and can be intermittently rotated by a predetermined angle. That is to say, the recording material P can be conveyed step by step by repeating the rotation and stoppage of the pressing roller 26.

The temperature controlling means 27 includes a CPU 23 for controlling a triac 24 to maintain a detection temperature of a thermistor (temperature detecting element) 21 attached to the rear surface of the ceramic heater 20 to a predetermined set temperature and for controlling energization to the ceramic heater 20.

As mentioned above, in the fixing apparatus 11, while the recording material is being conveyed through the fixing nip portion N by the rotation of the pressing roller 26 in the direction R26, the toner on the recording material P is heated by the ceramic heater 20. In this case, by controlling the rotation of the pressing roller 26 by means of the rotation controlling means 28, the conveyance of the recording material P can suitably be controlled, and the temperature of the ceramic heater 20 can suitably be controlled by the temperature controlling means 27.

Now, the present invention will be fully explained.

Figure 7:
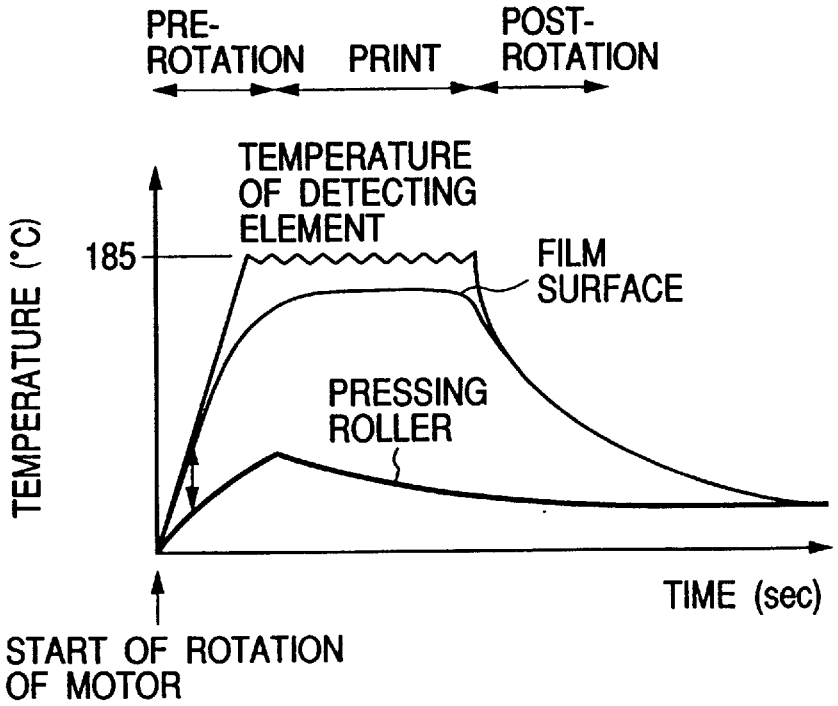
FIG. 7 is a graph showing conventional control, and a temperature relationship between a fixing film and a pressing roller.

FIG. 7 shows temperature conditions of the surface of the fixing film ("film surface" in FIGS. 3 to 7) and of the pressing roller 26 when image formation (referred to as "print" hereinafter) is effected by using a conventional fixing sequence. In the conventional fixing temperature control, since the heater 20 was put (turned) OFF in post-rotation, the temperature of the pressing roller and the fixing film were lowered. In such a condition, the toner adhered to the surface of the fixing film was transferred to the pressing roller 26 in a non-softened condition.

In the illustrated embodiment, temperature control is effected in such a manner that the toner adhered to the fixing film 25 in the fixing nip portion N is heated to a temperature greater than a toner softening temperature when the print is finished, thereby binding the toner particles together not to be transferred to the pressing roller 26.

In order to soften the offset toner adhered to the fixing film 25, it is required that the temperature of the toner be increased not less than 120° C.

Figure 3:
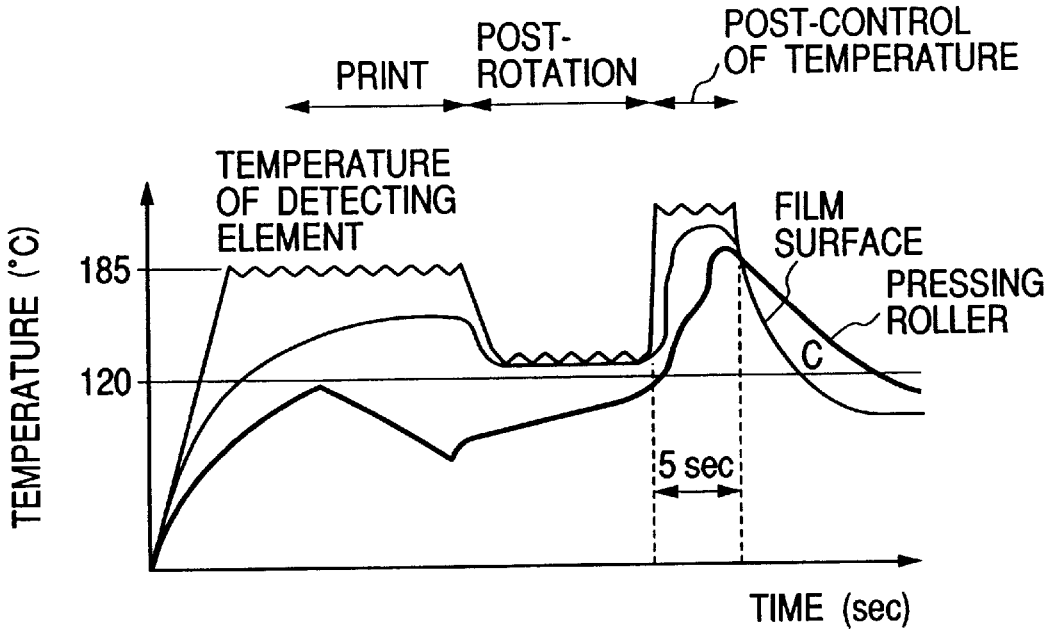
FIG. 3 is a graph showing control according to a first embodiment, and a temperature relationship between a fixing film and a pressing roller.

FIG. 3 shows fixing temperature control in this case, and a relationship between temperatures of the fixing film surface and of the pressing roller 26.

"Post-rotation" and "post-control of temperature" in FIG. 3 are temperature control when the print is finished. As apparent from FIG. 3, although the fixing temperature control temperature is 185° C. substantially the same as that in the conventional case, in the post-rotation immediately after the print, the constant temperature is maintained, unlike to the conventional case. The temperature of the pressing roller is increased to 120° C. (toner softening temperature). Further, when stopped, temperature control is effected in such a manner that, by effecting quick heating, the temperatures of the pressing roller and the film surface in the fixing nip portion to a temperature sufficient to soften the toner. By doing so, the toner particles in the fixing nip portion N can be bound together by the aid of expansion of the pressing roller 26. After the toner particles are bound, the temperature control is finished.

Since the fixing nip portion N is formed by the pressing roller 26 having high heat capacity and the fixing film having low heat capacity (easy to be cold), at the temperature greater than 120° C. (toner softening temperature), a condition (refer to "C" in FIG. 3) that the temperature of the surface of the fixing film becomes smaller than the temperature of the pressing roller 26 (gradually lowered) occurs. Accordingly, the bound toner starts to be transferred to the cold fixing film 25.

In such a condition, when the fixing apparatus 11 is rotated to effect next print, even if the toner particles alone are hard to be held on the fixing film 25, by binding the toner particles together, the toner can easily be held on the fixing film. And, the transferring of the toner held on the fixing film 25 in the fixing nip portion N onto the pressing roller 26 can be suppressed. Incidentally, when the fixing apparatus 11 is rotated, by lowering the temperature of the fixing nip portion N below the toner softening point, the amount of the toner adhered to the fixing film can be increased.

Since the recording material P entering into the fixing nip portion N has a room temperature, there is a temperature difference between the surface of the fixing film and the recording material P. The amount of the toner held on the fixing film 25 in the fixing nip portion N is an invisible extent, and such toner is adhered to the recording material P and is removed from the fixing film.

Since a part of the peripheral surface of the pressing roller 26 stopped in the fixing nip portion N after the print is varied whenever the pressing roller 26 is stopped, by repeating the print, the contamination can be removed from the entire peripheral surface of the pressing roller 26. Thus, the toner contamination can be prevented from being accumulated on the pressing roller 26.

When intermittent endurance tests (2 sheets/10 minutes) were carried out under the conventional temperature control, it was found that the pressing roller is contaminated after about 2000 sheets were treated. To the contrary, in the illustrated embodiment, by effecting the temperature control in which the post-rotation temperature control is 165° C., the post-control of temperature is 200° C. (5 seconds) and the temperature of the fixing nip portion in next print is not more than 100° C., it was found that the amount of the toner adhered to the pressing roller 26 can be reduced to half or less in comparison with the conventional temperature control and the toner contamination does not occur even after 4000 sheets were treated (intermittent endurance test).

Thus, in the illustrated embodiment, even if there is dispersion in surface coating of the pressing roller 26, since the toner adhesion to the pressing roller 26 can be prevented effectively, it is not required that the surface coating of the pressing roller 26 be maintained with high accuracy. Therefore, yield of the pressing roller 26 can be improved, and, thus, the entire apparatus can be made cheaper.

Second Embodiment

In the above-mentioned first embodiment, by the temperature control in the post-rotation, the toner is adhered to the fixing film 25 to remove the toner contamination from the pressing roller 26. In this case, the contamination of the pressing roller 26 is considerably suppressed. However, there is not still adequate margin for the service life of the roller. In order to further suppress the contamination of the pressing roller 26, in a second embodiment of the present invention, by effecting the temperature control for the surface of the fixing film and the pressing roller before the print, the toner can be prevented from transferring to the pressing roller 26.

Figure 4:
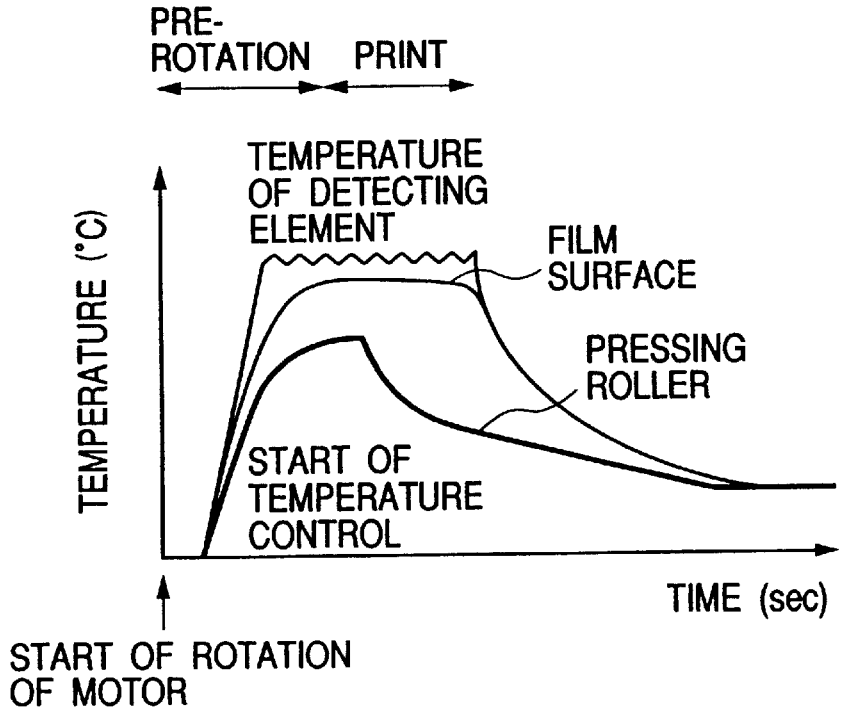
FIG. 4 is a graph showing control according to a second embodiment, and a temperature relationship between a fixing film and a pressing roller.

FIG. 4 shows the temperature control according to the second embodiment. Incidentally, since the construction of the entire image forming apparatus and the construction of the fixing apparatus 11 are the same as those in the first embodiment, explanation thereof will be omitted.

In the past, as shown in FIG. 7, the heating was started at the same time when the rotation of the motor was started. To the contrary, in the illustrated embodiment, control in which a part of the pressing roller 26 located in the fixing nip portion N is shifted when the print signal is inputted in a condition that there is no temperature difference between the surface of the fixing film and the pressing roller 26 (i.e., control in which the rotation is started before the heating is started) is effected. FIG. 4 shows the temperatures of the surface of the fixing film and the pressing roller 26 in this case. As can be seen from FIG. 7, in the conventional case, since the temperature of the surface of the fixing film is suddenly increased and the temperature of the pressing roller 26 is slowly increased before the pre-rotation is started, the toner existing within the fixing nip portion N is transferred to the pressing roller 26 which has lower temperature. In the illustrated embodiment, by rotating the pressing roller 26 before the heating is started, the part of the pressing roller 26 located in the fixing nip portion N is shifted, with the result that the toner held on the fixing film 25 in the fixing nip portion N can be prevented from being transferred to the pressing roller 26. Incidentally, in this case, more effective effect can be achieved when the temperature of the fixing nip portion N is maintained below the toner softening temperature. The fact that rotation corresponding to a nip width a of the fixing nip portion N is effected in the condition that there is no temperature difference is more effective to suppress the transferring of the toner to the pressing roller 26.

Further, since the recording material P entering into the fixing nip portion N has a room temperature, there is a temperature difference between the surface of the fixing film and the recording material P. The amount of the toner held on the fixing film 25 in the fixing nip portion N is an invisible extent, and such toner is adhered to the recording material P and is removed from the fixing film.

When intermittent endurance tests (2 sheets/10 minutes) were carried out under the conventional temperature control, it was found that the pressing roller is contaminated after about 2000 sheets were treated. To the contrary, by using the illustrated embodiment, the endurance life of the pressing roller corresponding to about 6000 sheets can be ensured. Therefore, the toner can be prevented from being accumulated on the pressing roller 26, and, thus, the grade of the fixing apparatus 11 including the pressing roller 26 can be reduced to make the entire apparatus cheaper, and the service life of the fixing apparatus 11 can be extended.

Third Embodiment

In the above-mentioned first and second embodiments, by reducing the amount of the toner transferred from the surface of the fixing film to the pressing roller 26 in the pre-rotation and the post-rotation respectively, toner contamination on the pressing roller 26 can be suppressed to extend the endurance life of the fixing apparatus 11. Further, in these embodiments, the contamination of the pressing roller 26 is considerably reduced.

However, due to dispersion surface coating and manufacturing dimension of the pressing roller 26, the toner transferred from the fixing apparatus 11 to the recording material P may become visible to cause poor image.

To avoid this, in a third embodiment of the present invention, the pre-rotation and the post-rotation are controlled on demand so that the amount of the toner transferred is optimized, thereby preventing the poor image while reducing the toner contamination of the fixing apparatus 11.

Figure 5:
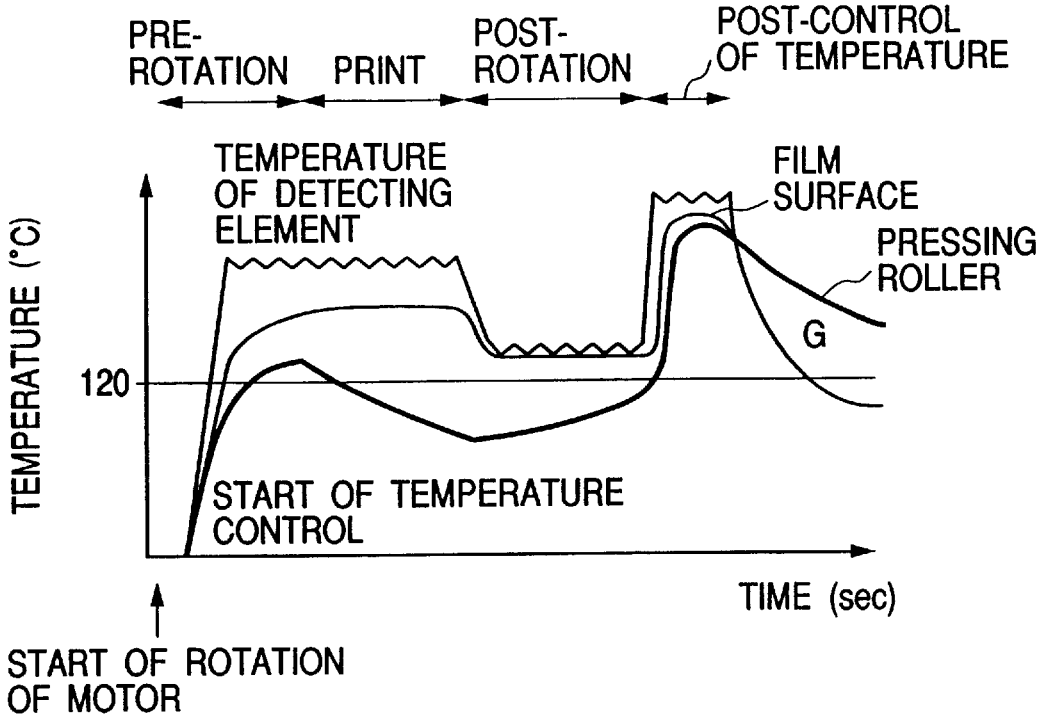
FIG. 5 is a graph showing control according to a third embodiment, and a temperature relationship between a fixing film and a pressing roller.

FIG. 5 shows such fixing temperature control. Further, the temperatures of the surface of the fixing film and of the pressing roller 26 under this control are also shown. In the illustrated embodiment, the pre-rotation control used in the second embodiment is utilized, and post-rotation control suitable to such pre-rotation control is effected.

In the second embodiment, the amount of the toner transferred from the surface of the fixing film to the pressing roller 26 could be more reduced in comparison with the conventional temperature control. However, in order to hold a greater amount of toner on the fixing film 25 in the pre-rotation, in the third embodiment, the control for heating the fixing nip portion N (as is in the first embodiment) before the previous print is finished. The toner in the binding condition is shifted from the fixing nip portion by pre-rotation for the present print not to be transferred to the pressing roller, and the toner adhered to the fixing film during the print is adhered to the recording material P in an invisible form. By changing the temperature control of the post-rotation and the post-control of temperature, the binding amount of toner on the surface of the fixing film and the amount of toner transferred to the recording material P can be optimized.

According to the illustrated embodiment, by effecting the control in which the temperature of the post-rotation is 165° C. and the post-control of temperature is 200° C. (5 seconds) and by shifting the fixing nip portion N in the pre-rotation, (although the contamination occurred after pass of 2000 sheets in the conventional case) any contamination does not occur even after pass of 20000 sheets, and the output image does not have visible contamination.

By effecting such control, the service life of the fixing apparatus 11 can be extended and the occurrence of the poor image can be prevented, which are advantageous superior to the conventional cases.

Fourth Embodiment

In the above-mentioned first to third embodiments, by cleaning the part of the pressing roller 26 located in the fixing nip portion N after each print is finished, the contamination such as toner is prevented from being accumulated on the pressing roller 26. In a fourth embodiment of the present invention, as shown in FIG. 6, by always performing the cleaning sequence in the waiting condition, the endurance life can be further extended.

Figure 6:
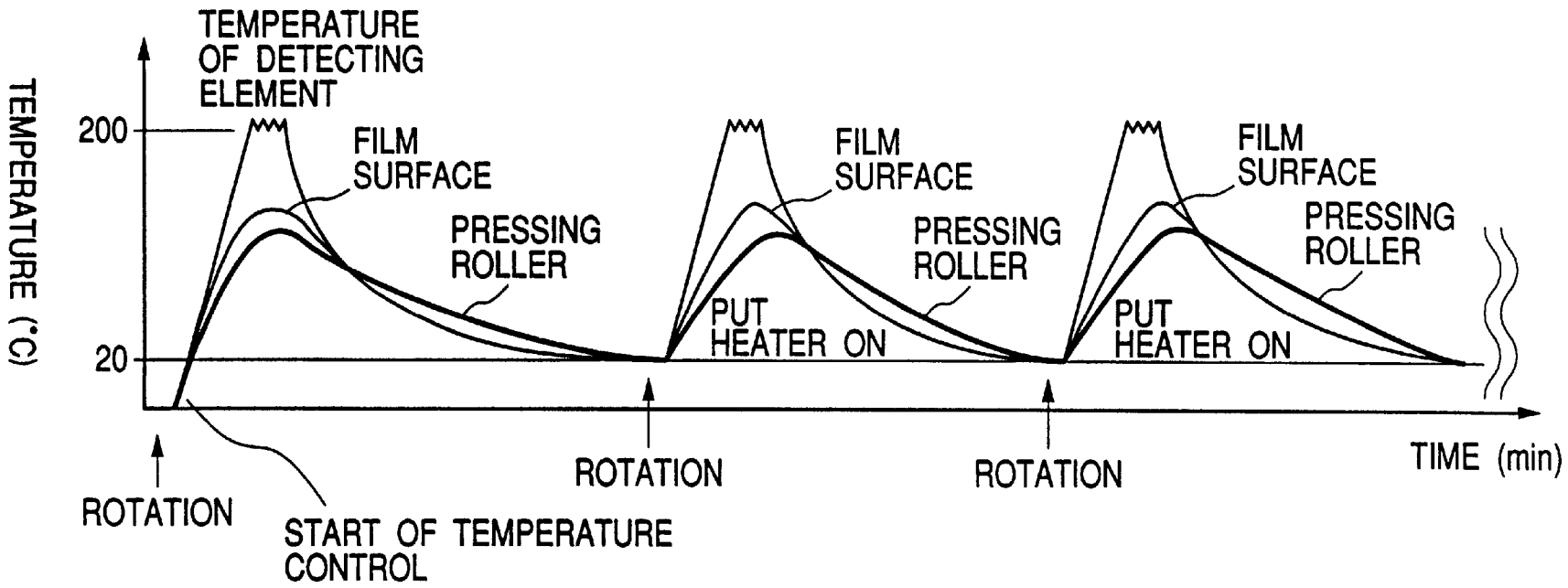
FIG. 6 is a graph showing control according to a fourth embodiment, and a temperature relationship between a fixing film and a pressing roller.

As shown in FIG. 6, after the print is finished, a thermistor (temperature detecting element) 21 judges that the fixing nip portion N becomes cold adequately. And, the cleaning effect is improved by repeating the rotating the fixing nip portion N, as mentioned above.

According to this embodiment, in the waiting condition, by effecting the temperature control of 200° C. (for 5 seconds) after the pre-rotation of 12 mm was effected and by repeating the waiting for cooling to 20° C., (although the contamination occurred after 2000 sheets in the conventional case) any contamination does not occur even after 50000 sheets.

By using this embodiment, since the contamination can effectively be prevented from being accumulated on the pressing roller 26, the grade of the fixing apparatus 11 can be reduced, thereby making the entire fixing apparatus cheaper. Further, the endurance life of the fixing apparatus 11 can be extended.

In the above-mentioned first to fourth embodiments, while an example that the fixing apparatus is of film heating type was explained, the present invention can be applied to a fixing apparatus of heat roller type in which a heat roller and a pressing roller are used as fixing rotary members.

Next, an embodiment in which a fixing temperature during the print can be set properly while effecting the toner adhesion (to a pressing roller) preventing sequence will be described.

Fifth Embodiment

In the past, as shown in FIG. 7, the heating was started at the same time when the rotation of motor was started.

Figure 8:
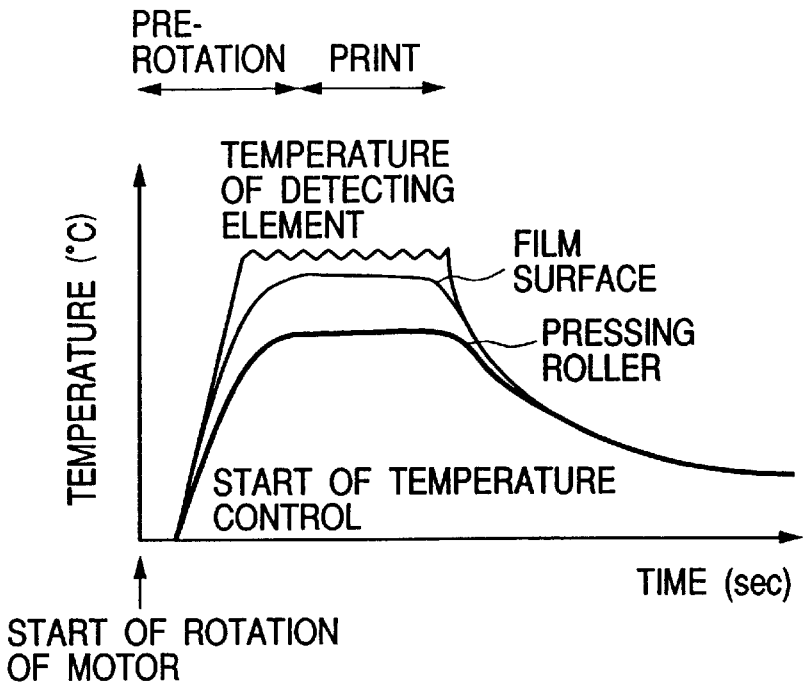
FIG. 8 is a graph showing control according to a fifth embodiment, and a temperature relationship between a fixing film and a pressing roller.

To the contrary, in a fifth embodiment of the present invention, as shown in FIG. 8, control in which a part of the pressing roller 26 located in the fixing nip portion N is shifted when the print signal is inputted in a condition that there is no temperature difference between the surface of the fixing film and the pressing roller 26 (i.e., control in which the rotation is started before the heating is started) is effected. As can be seen from FIG. 7, in the conventional case, since the temperature of the surface of the fixing film is suddenly increased and the temperature of the pressing roller 26 is slowly increased during the pre-rotation, the toner existing within the fixing nip portion N is transferred to the pressing roller 26 which has lower temperature.

In the illustrated embodiment, the temperature control is effected as follows. That is to say, when the print is finished, the fixing nip portion N is heated to a temperature greater than the temperature for softening the toner adhered to the fixing film 25 to bind the toner particles together, thereby preventing the toner from transferring to the pressing roller 26.

In order to soften the offset toner adhered to the fixing film 25, it is required that the temperature of the toner be increased not less than 120° C.

Figure 9:
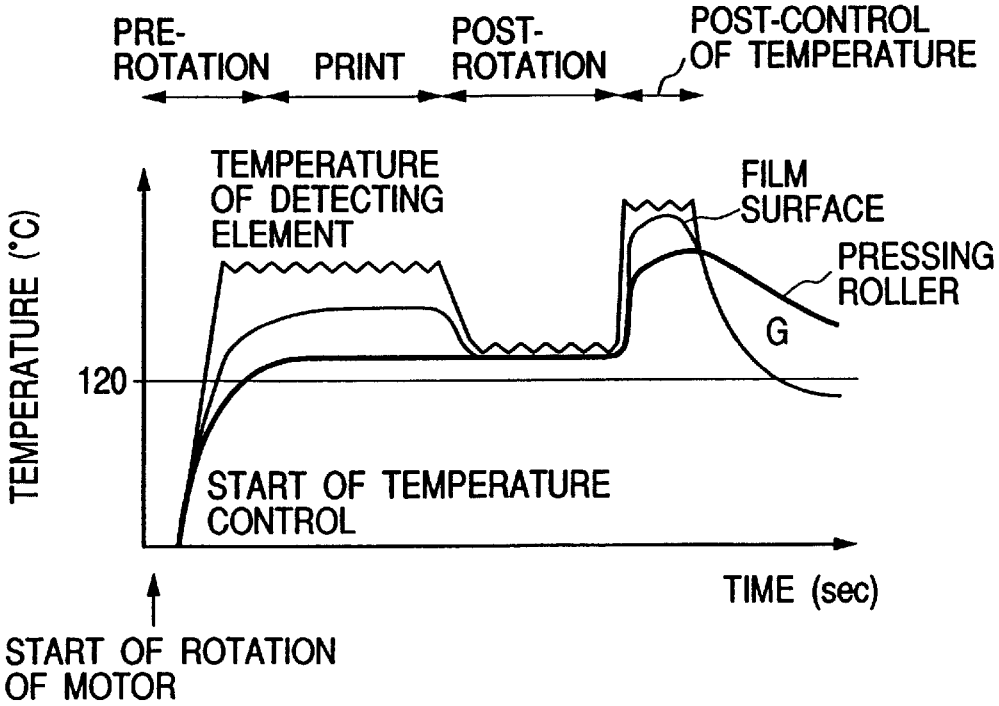
FIG. 9 is a graph showing control according to the fifth embodiment, and a temperature relationship between the fixing film and the pressing roller.

FIG. 9 shows fixing temperature control in this case, and a relationship between temperature of the fixing film surface and of the pressing roller 26. "Post-rotation" and "post-control of temperature" in FIG. 9 are temperature control when the print is finished. As apparent from FIG. 9, although the fixing temperature control temperature is 185° C. substantially the same as that in the conventional case, in the post-rotation immediately after the print, the constant temperature is maintained, unlike to the conventional case. The temperature of the pressing roller is increased to 120° C. (toner softening temperature). Further, when the roller is stopped, temperature control is effected in such a manner that, by effecting quick heating, the temperatures of the pressing roller and of the film surface in the fixing nip portion N to a temperature sufficient to soften the toner. This control temperature may be maintained at 200° C. for about five seconds. By doing so, the toner particles in the fixing nip portion N can be bound together by the aid of expansion of the pressing roller 26. After the toner particles are bound, the temperature control is finished.

Since the fixing nip portion N is formed by the pressing roller 26 having high heat capacity and the fixing film having low heat capacity (easy to be cold), at the temperature not less than 120° C. (toner softening temperature), a condition (refer to "G" in FIG. 9) that the temperature of the surface of the fixing film becomes smaller than the temperature of the pressing roller 26 (gradually lowered) occurs. Accordingly, the bound toner starts to be adhered to the cold fixing film 25.

In such a condition, when the fixing apparatus 11 is rotated, even if the toner particles alone are hard to be held on the fixing film 25, by binding the toner particles together, the toner can easily be held on the fixing film 25. And, the transferring of the toner held on the fixing film 25 in the fixing nip portion N onto the pressing roller 26 can be suppressed. Incidentally, when the fixing apparatus 11 is rotated, by lowering the temperature of the fixing nip portion N below the toner softening point, the amount of the toner adhered to the fixing film 25 can be further increased.

Since the recording material P entering into the fixing nip portion N has a room temperature, there is a temperature difference between the surface of the fixing film and the recording material P. The amount of the toner held on the fixing film 25 in the fixing nip portion N is an invisible extent, and such toner is adhered to the recording material P and is removed from the fixing film 25.

Since a part of the peripheral surface of the pressing roller 26 stopped in the fixing nip portion N after the print is varied whenever the pressing roller 26 is stopped, by repeating the print, the contamination can be removed from the entire peripheral surface of the pressing roller 26. Thus, the toner contamination can be prevented from being accumulated on the pressing roller 26.

Now, a case where the next print is effected after the toner removal control is considered.

Normally, in case of a fixing apparatus 11 having such a fixing film 25, the temperature of the fixing apparatus 11 is measured before the print is started (before the heating of the fixing apparatus 11 is started), and, on the basis of the warming extent of the apparatus, the control temperature during the print (during the fixing) is determined. The reason is that, if the fixing apparatus 11 is well warmed immediately after the previous print, excessive heat will be supplied to the recording material P to cause offset, and, if insufficient heat is supplied to the recording material, poor fixing will occur.

However, if this system is combined with the above-mentioned toner removing sequence, since the heat is supplied only to the fixing nip portion N, temperature detection becomes incorrect. In the illustrated embodiment, after the a part which was heated by post-heating after the previous print is shifted from the fixing nip portion N, the temperature of the fixing apparatus 11 is detected, thereby solving the above problem. The temperature detection may be performed by using the thermistor 21 attached to the ceramic heater 20.

Figure 10A:
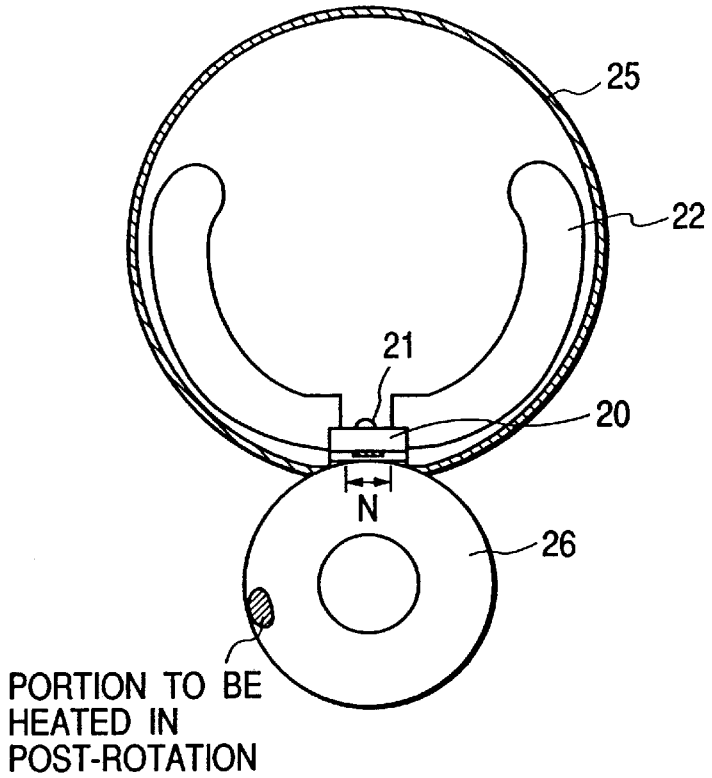
FIG. 10A is a view showing temperature detection when the fifth embodiment of the present invention is applied.
Figure 10B:
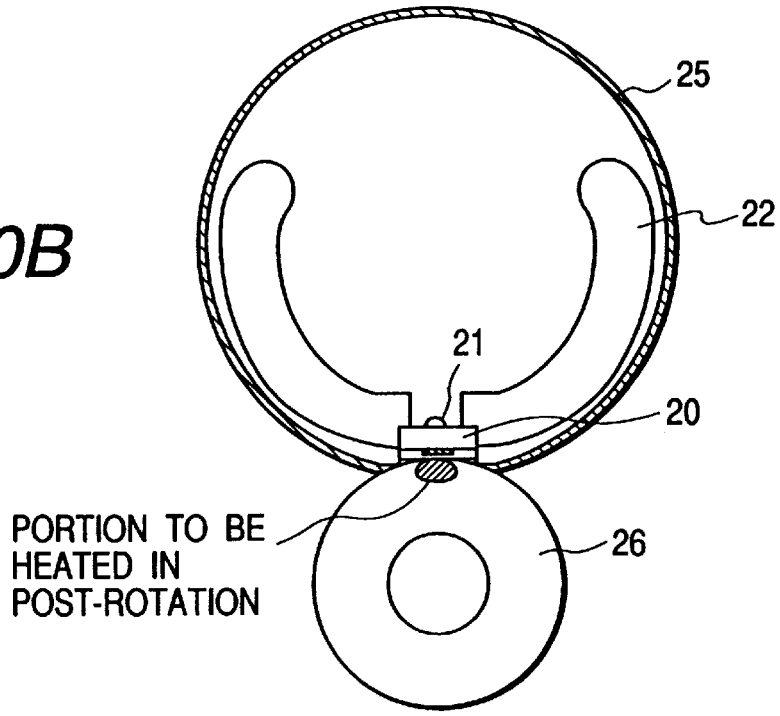
FIG. 10B is a view showing temperature detection when the present invention is not applied.

FIG. 10A shows the temperature detection according to the illustrated embodiment, and FIG. 10B shows the temperature detection to which the illustrated embodiment is not applied.

Figure 11:
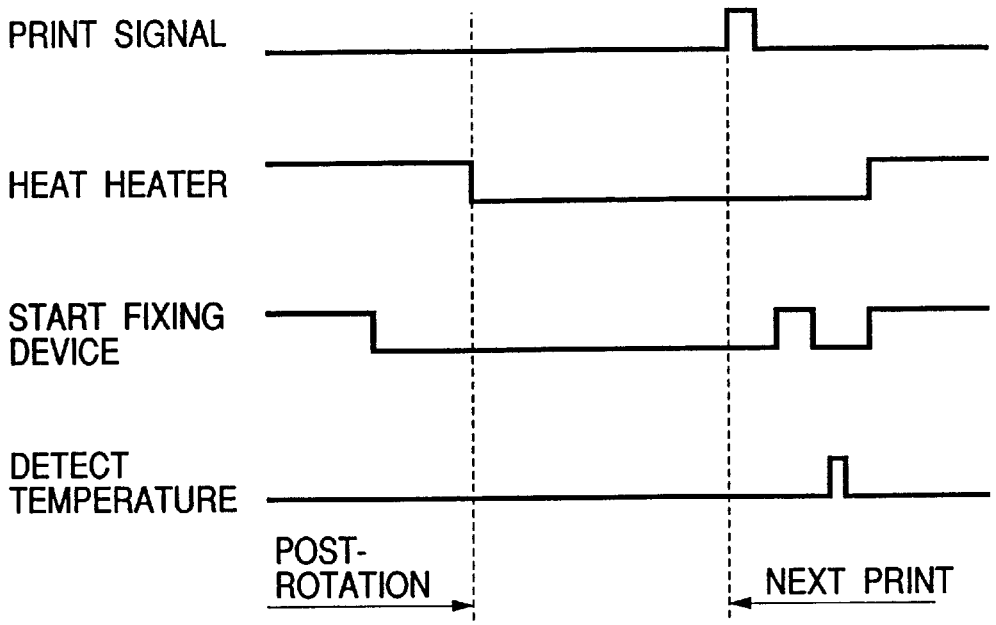
FIG. 11 is a timing chart according to the fifth embodiment.

FIG. 11 is a timing chart according to the illustrated embodiment. In FIG. 11, regarding "print signal", "heat heater", "start fixing device (fixing apparatus)" and "detect temperature", each higher level indicates an energization condition or a starting condition.

Methods for determining the control temperature during the print on the basis of the temperature of the fixing apparatus 11 detected in this way are disclosed in Japanese Patent Application Laid-open Nos. 5-289562, 6-242700 and 7-248700, for example.

In the illustrated embodiment, when the condition of the fixing apparatus 11 is detected, since parts of the pressing roller 26 and the fixing film 25 which are not heated are used, the warming condition of the apparatus can be measured correctly. On the other hand, in the case to which the illustrated embodiment is not applied, if the print is effected again immediately after the previous print, the heat is still remaining in the fixing nip portion N, with the result that, since the control temperature for the next print is set to lower, the poor fixing will occur.

When intermittent endurance tests (2 sheets/10 minutes) were carried out under the conventional temperature control, it was found that the pressing roller is contaminated after about 2000 sheets were treated. To the contrary, in the illustrated embodiment, by effecting the temperature control in which the post-rotation temperature control is 165° C., the post-control of temperature is 200° C. (5 seconds) and the temperature of the fixing nip portion in the next print is not more than 100° C. (first temperature control value), it was found that, by effecting the temperature control (first temperature control), the amount of the toner adhered to the pressing roller 26 can be reduced to half or less in comparison with the conventional temperature control and the toner contamination does not occur even after 4000 sheets were treated (intermittent endurance test).

Thus, in the illustrated embodiment, even if there is dispersion in surface coating of the pressing roller 26, since the toner adhesion to the pressing roller 26 can be prevented effectively, it is not required that the surface coating of the pressing roller 26 be maintained with high accuracy. Therefore, yield of the pressing roller 26 can be improved, and, thus, the entire apparatus can be made cheaper.

Incidentally, in the illustrated embodiment, it is most preferable that a timing for detecting the temperature of the fixing apparatus 11 corresponds to about a half of one revolution of the pressing roller 26. The reason is that, in this position, the warmed part is furthest from the fixing nip portion N and a part which was remote from the fixing nip portion and to which the heat is not transferred reaches the fixing nip portion N. The reason for utilizing the pressing roller 26 as the reference is that the pressing roller thermally affects an influence upon the detection of the temperature of the ceramic heater 20.

Sixth Embodiment

In the above-mentioned fifth embodiment, while an example that the pair of rollers are rotated by the predetermined amount before the rising-up of the heater and then the temperature of the heater is detected was explained, in a sixth embodiment of the present invention, the temperature is measured before the rotation, and, if not warmed, the detected temperature is used for determining the control temperature as it is, and, only when warmed, the pressing roller 26 is rotated to shift the fixing nip portion N, and, thereafter, the temperature detection is effected. Judgement whether warmed or not is carried out by using a threshold value of 50° C. (second control temperature). If the temperature is not less than 50° C., it is judged as the warmed condition, and, if the temperature is less than 50° C., it is judged as the non-warmed condition.

As a result, the fixing apparatus 11 is not rotated excessively, thereby reducing the load to the fixing apparatus 11. If the fixing nip portion N is started in the low temperature condition, since viscosity of the grease coated on the inner surface of the fixing film 25 is great, starting torque is increased to act excessive load on gears and the fixing film 25. This is not preferable. In the illustrated embodiment, inconvenience such as skipping of gear teeth and/or wrinkling of the fixing film 25 can be avoided.

Seventh Embodiment

In the above-mentioned sixth embodiment, while the starting method in the print was changed, in a seventh embodiment of the present invention, this is effected also in the post-rotation. That is to say, after the roller is stopped upon finish of the print, the fixing nip portion N is heated to a temperature greater than the toner softening temperature (about 100° C.), and the heating for about five seconds melts the toner to form relatively large toner particles. Then, after the temperature of the fixing nip portion N is lowered below the toner softening point, the pair of rollers are rotated in the non-heating condition to shift the fixing nip portion N. Such a shifting amount is greater than the nip width of the fixing nip portion N and smaller than one revolution.

Figure 12:
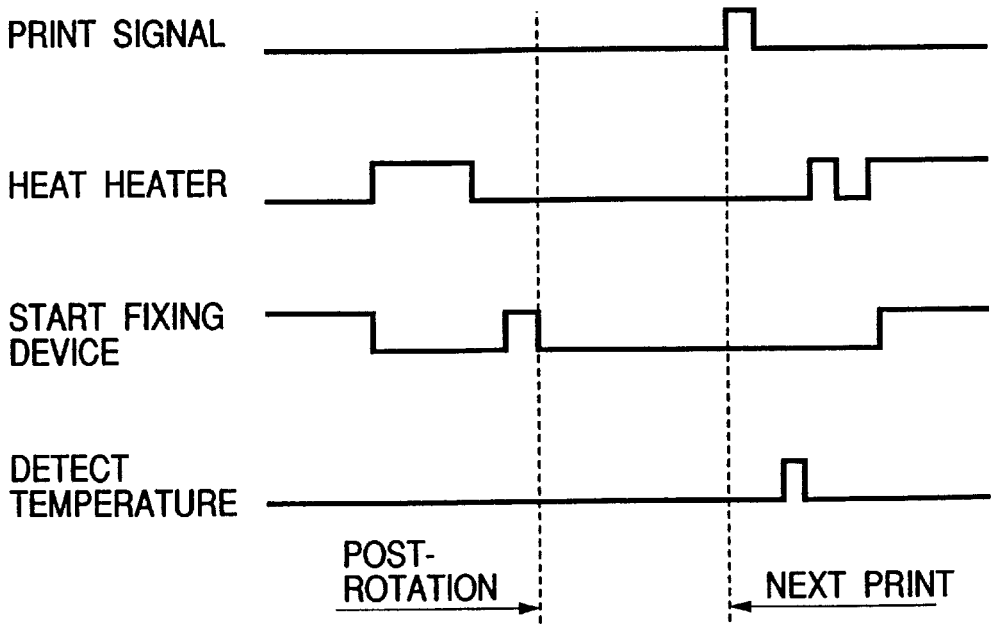
FIG. 12 is a timing chart according to a seventh embodiment.
Figure 13:
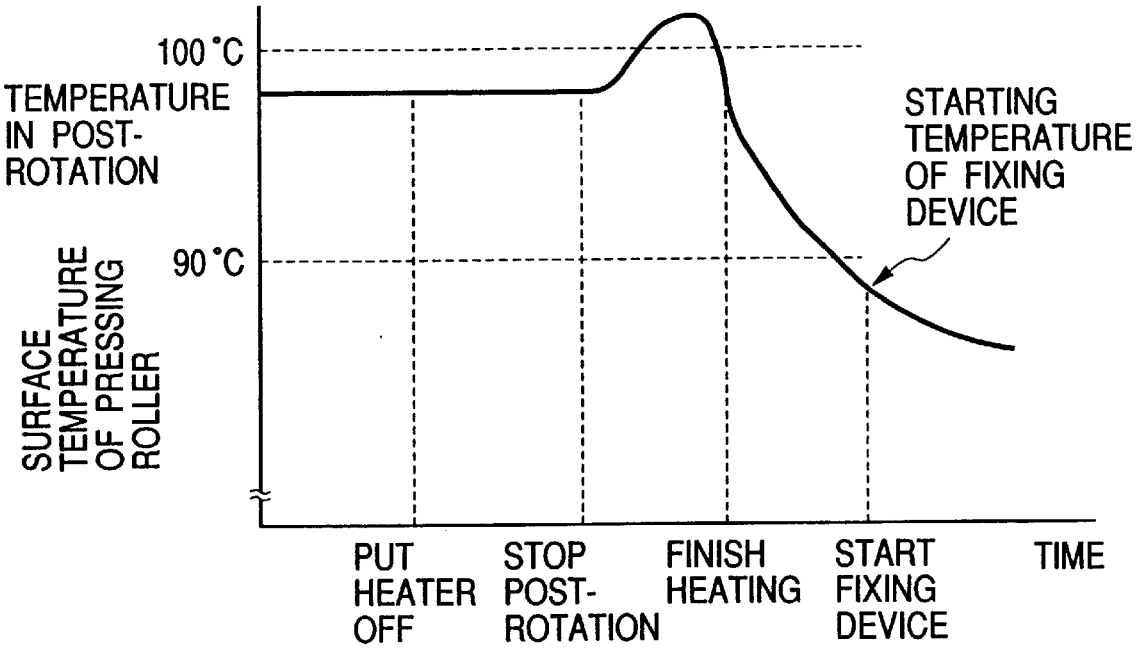
FIG. 13 is a graph showing change in temperature of the pressing roller in the seventh embodiment.

FIG. 12 is a timing chart according to the illustrated embodiment. Each high level indicated an energization condition or a starting (rotating) condition. When the rollers are immediately rotated at a temperature below the softening temperature (for example, 90° C.), since the grease is well warmed and the low viscosity at this point, the rollers can be rotated very smoothly. This condition is shown in FIG. 13.

When such rotation is added to the post rotation, the next print can be started immediately. That is to say, when the print is started, since the part of the pressing roller located in the nip is not required to be shifted and the temperature detection for detecting the warming condition of the apparatus can be performed immediately, the clean condition can be maintained without extending the first print time and damaging the fixing apparatus 11.

Eighth Embodiment

In the above-mentioned fifth embodiment, while an example that the fixing apparatus 11 continues to be heated during the post-rotation to maintain 120° C. was explained, an eighth embodiment of the present invention, the heating is stopped in the post-rotation. For example, when a trailing end of the recording material P is detected by a sheet sensor disposed at a downstream side of the fixing apparatus 11, the heating is stopped to cool the fixing apparatus. Meanwhile, the rotation is maintained.

Figure 14:
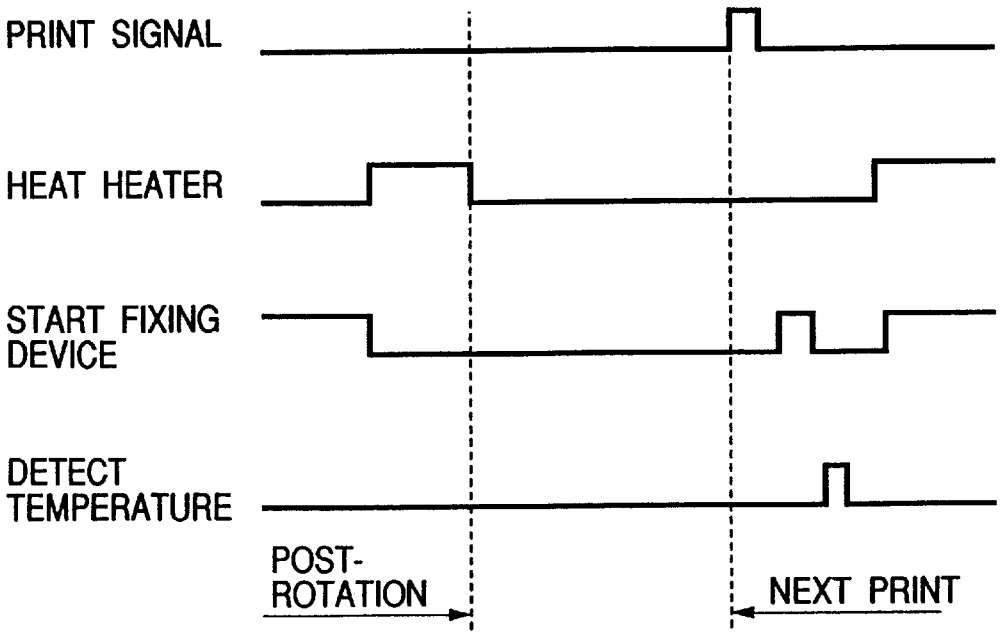
FIG. 14 is a timing chart according to an eighth embodiment.
Figure 15:
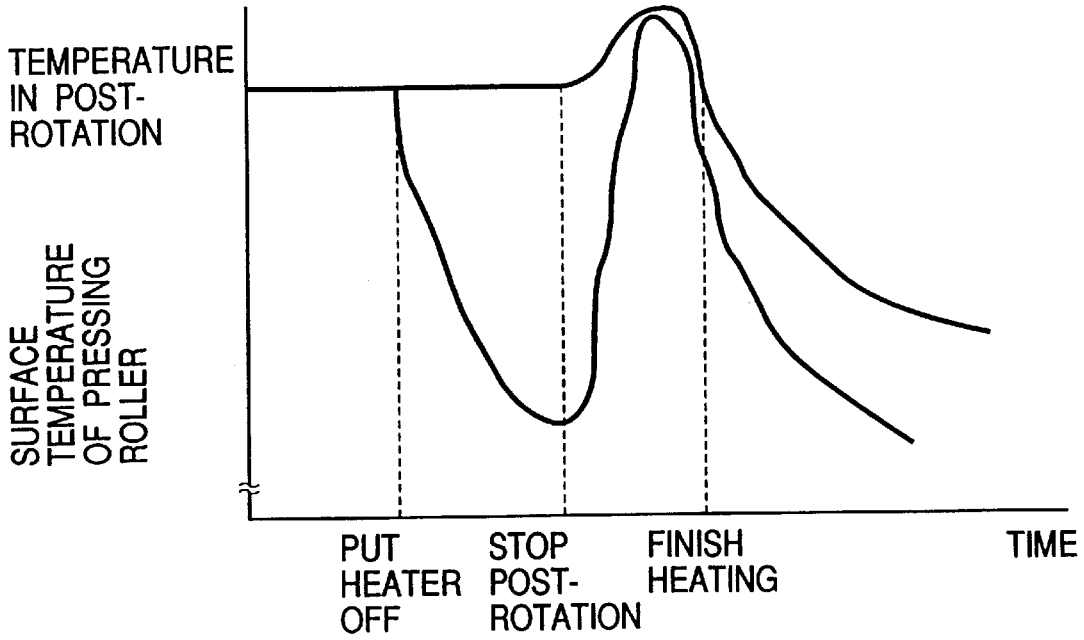
FIG. 15 is a graph showing change in temperature of the pressing roller in the eighth embodiment.

FIG. 14 is a timing chart according to the illustrated embodiment. Each high level indicated an energization condition or a starting condition. Since the heating is stopped in the post-rotation, the temperature of the pressing roller 26 and of the fixing film 25 are low. Thus, after stoppage, the cooling speed after the fixing nip portion N was heated is increased, whereby the temperature of the fixing nip portion N can easily be reduced below the softening point before the next print is started. This condition is shown in FIG. 15.

The eighth embodiment can also be applied to the sixth and seventh embodiments.

According to the above-mentioned first to eighth embodiments, in the condition that the rotary members are stopped after the print was finished, the toner located in the fixing nip portion is heated to the temperature greater than the toner softening temperature (FIG. 16) to bind the toner particles together by melting to facilitate the transferring of the toner, and the toner is adhered to the fixing film (or fixing roller) by cooling the toner by natural radiation. At the point when the print is finished, since the pressing roller is still warmed, the melted and bound toner is adhered to the film (which has poor mold releasing ability) by cooling.

By rotating the fixing rotary member in such a condition, if the toner particles alone are hard to be held on the fixing film, by binding the toner particles together, the toner can easily be held on the fixing film. And, the transferring of the toner in the fixing nip portion onto the pressing roller can be suppressed. (When the fixing apparatus is rotated, by lowering the temperature of the fixing nip portion below the toner softening point, the amount of the toner adhered to the fixing film can be further increased).

When the print is started in the condition that the toner is adhered to the fixing film, since the recording material entering into the fixing nip portion has a room temperature, there is a temperature difference between the surface of the fixing film and the recording material. The amount of the toner held on the fixing film in the fixing nip portion is an invisible extent, and such toner is adhered to the recording material and is removed from the fixing film. Accordingly, even if the toner is adhered to the pressing roller, when the toner is heated and cooled in the nip after the print was finished, the toner is transferred to the film and is removed by the recording material during the next print.

Since a part of the peripheral surface of the pressing roller stopped in the fixing nip portion after the print is varied whenever the pressing roller is stopped, by repeating the print, the contamination can be removed from the entire peripheral surface of the pressing roller. Thus, the toner contamination can be prevented from being accumulated on the pressing roller.

Figure 17:
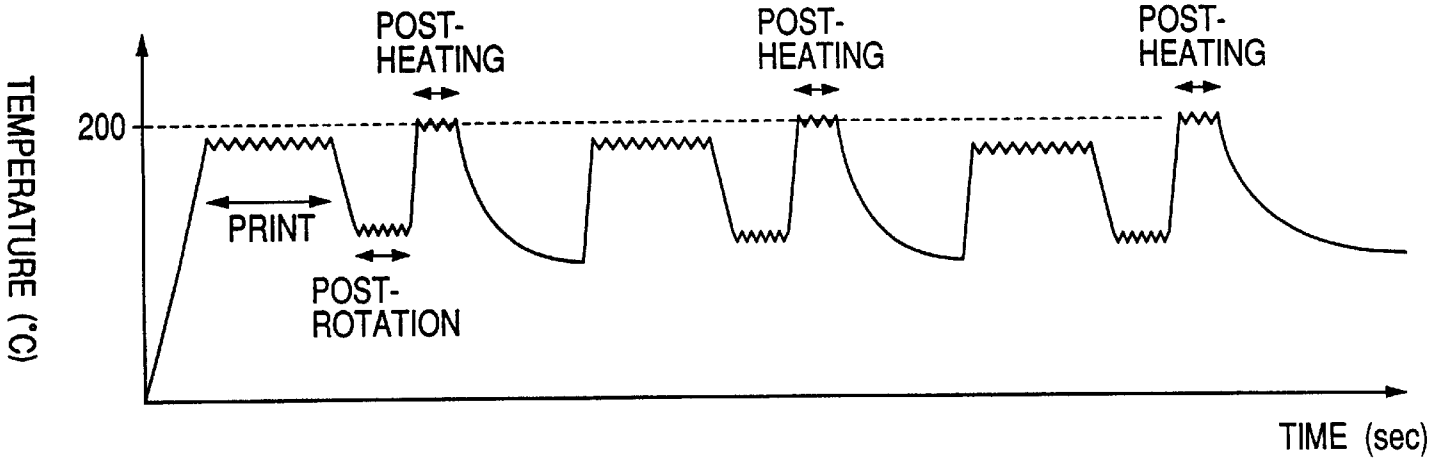
FIG. 17 is a graph showing intermittent print temperature in the temperature control in the first embodiment.

However, in the above examples, since the nip portion is always heated with the predetermined temperature (for about five seconds) every after the print is finished, as shown in FIG. 17, when the intermittent prints are effected continuously, the nip portion is heated substantially continuously for every time.

Since the temperature of the pressing roller is increased by such heating, the toner in the nip portion is not cooled adequately, with the result that the toner may be removed via the recording material efficiently.

The following embodiments can solve the problem occurred when the intermittent prints are effected continuously.

Ninth Embodiment

Figure 16:
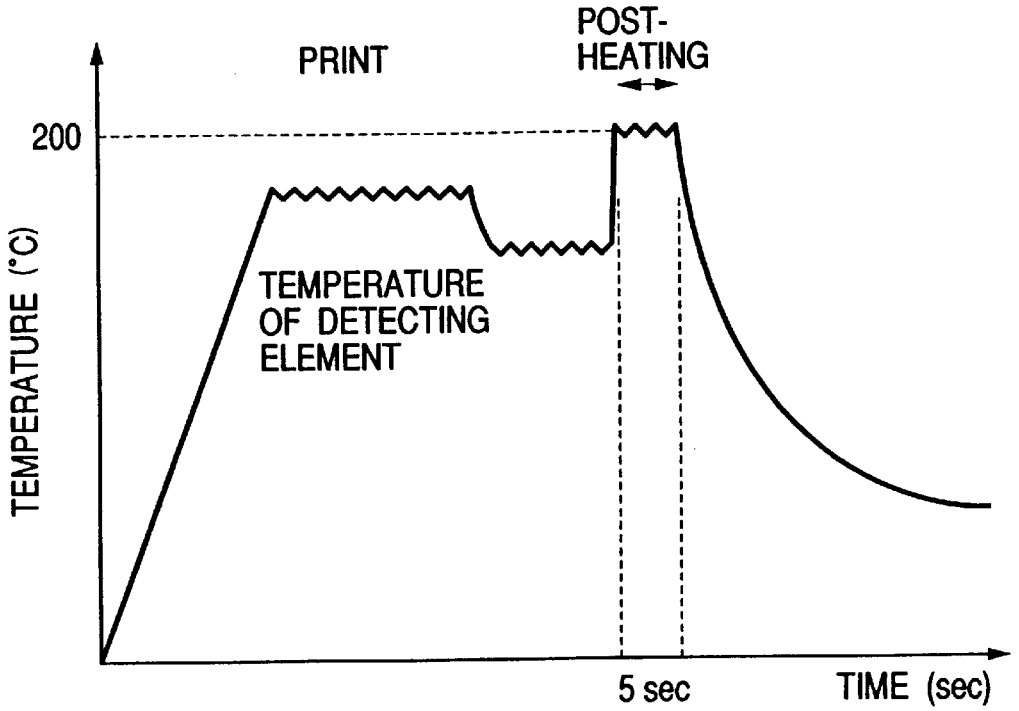
FIG. 16 is a graph showing temperature control of a fixing rotary member shown in the first embodiment.

In controls shown in FIGS. 16 and 17, since the heating is effected with a predetermined temperature after the print is finished regardless of the condition of the fixing rotary member, in an initial condition, although the nip portion is moderately heated and the toner is adhered to the fixing film, after several recording materials are printed, in the warmed condition of the fixing rotary member, if the nip portion is heated to be the same temperature as that in the initial condition, the nip portion becomes hard to be cooled and the toner becomes hard to be adhered to the fixing film. Further, as shown in FIG. 17, by repeating the heating of the nip portion, the fixing unit becomes hot, thereby causing the hot offset.

Figure 18:
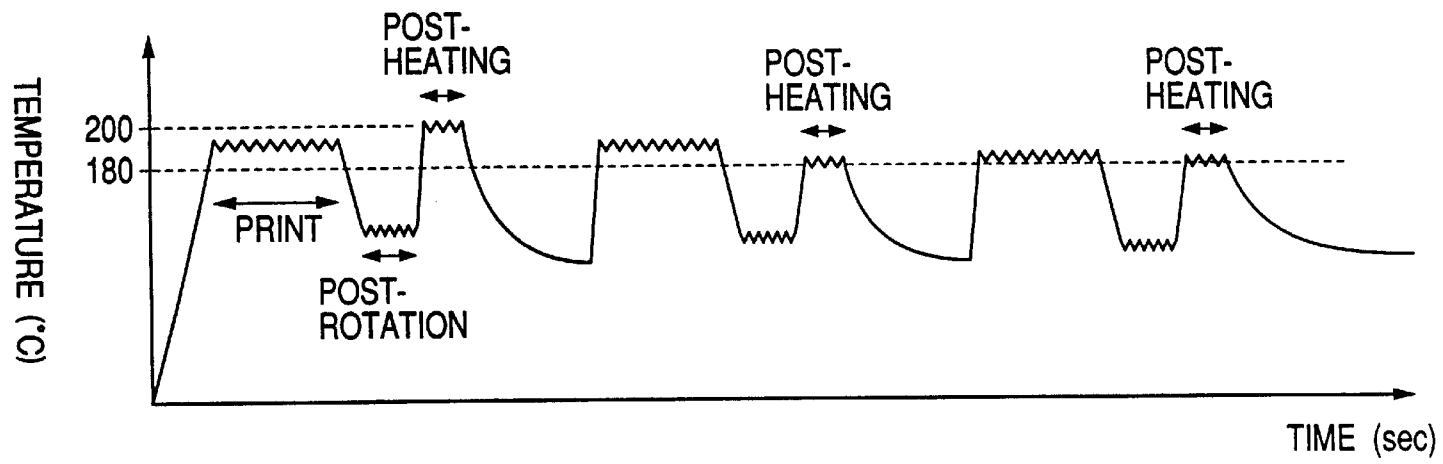
FIG. 18 is a graph showing temperature control in intermittent print according to a ninth embodiment.

In a ninth embodiment of the present invention, as shown in FIG. 18, a temperature (heater temperature) of the fixing device (fixing apparatus) before the print is started is measured. In this case, if the temperature is smaller than 105° C., the post-heating is selected to 200° C., and, if the temperature is greater than 105° C., the post-heating is selected to 180° C. In this way, even when the post-heating is effected every time in which the print signals are inputted continuously, the temperature of the pressing roller is maintained moderately, thereby cooling the toner in the nip portion sufficiently. Therefore, the toner can be removed via the recording material, and problems such as poor image due to hot offset and increase in temperature within the apparatus can be prevented.

Incidentally, in case of the continuous print, the post-heating is effected after the continuous print is finished.

For example, under an environment having a temperature of 23° C. and humidity of 60%, when a sheet pass endurance test was effected in a print mode in which one recording material including $CaCO_3$ of 10% to 15% is printed for every 25 seconds (i.e., the post-heating is effected every time), in the conventional cases, the hot offset was generated after pass of 50 sheets, thereby contaminating the pressing roller. However, in the illustrated embodiment, it was found that, even after pass of 20000 sheets, the hot offset and the contamination of the pressing roller did not occur.

By the illustrated embodiment, problems such as poor image due to hot offset and increase in temperature within the apparatus can be prevented and the toner contamination can be prevented from being accumulated on the fixing rotary member, whereby inconvenience such as the adhering of the recording material around the fixing rotary member and excessive contamination of the recording material due to the toner contamination accumulated on the fixing rotary member can be prevented.

Tenth Embodiment

In a tenth embodiment of the present invention, as shown in FIG. 19, the temperature of the fixing rotary member at the start of the print is detected, and, on the basis of a detected temperature, a temperature of the post-heating is determined. Consequently, the temperature control temperature of the post-heating from the initial condition to the well warmed condition of the pressing roller can be changed, with the result that the fixing rotary member can always be maintained to the optimum temperature, thereby removing the toner (causing the contamination) efficiently.

For example, under an environment having a temperature of 23° C. and humidity of 60%, when a sheet pass endurance test was effected in a print mode in which recording materials including $CaCO_3$ of 10% to 15% are used and the post-heating is effected every time, in the conventional cases, the hot offset was generated after pass of 50 sheets, thereby contaminating the pressing roller. However, in the illustrated embodiment, it was found that, even after pass of 50000 sheets, the hot offset and the contamination of the pressing roller did not occur. Of course, since the optimum temperature control temperatures are different from each other for every fixing apparatus due to the heat capacity of the fixing apparatus and the like, the heating time period may be controlled on the basis of the condition of the fixing rotary member.

By the illustrated embodiment, problems such as poor image due to hot offset and increase in temperature within the apparatus can be prevented and the toner contamination can be prevented from being accumulated on the fixing rotary member, whereby inconvenience such as the adhering of the recording material around the fixing rotary member and excessive contamination of the recording material due to the toner contamination accumulated on the fixing rotary member can be prevented. Further, abnormal increase in temperature of the fixing rotary member can be prevented to obtain good image output, and, since power consumption can be suppressed, the increase in temperature within the apparatus can be avoided.

In the above-mentioned embodiments, while the temperature of the post-heating was set on the basis of the temperature of the pressing roller before the print is started, when the continuous print is effected, since the pressing roller is gradually warmed, it is preferable that the temperature control temperature during the fixing process is gradually lowered in order to keep the temperature of the nip to the temperature suitable for the fixing. Accordingly, when the temperature control temperature during the fixing process is switched in this way, the set temperature of the post-heating after the fixing process may be set on the basis of the fixing temperature during the fixing process.

In the above-mentioned embodiments, while the fixing apparatus of film heating type was explained, the present invention can effectively be applied to a fixing apparatus of heat roller type including a heat roller and a pressing roller.

The present invention is not limited to the above-mentioned embodiments, but, various alterations and modifications can be made within the scope of the invention.

What is claimed is:

1. An image fixing apparatus comprising:

a heating member;

a back-up roller cooperating with said heating member to form a nip therebetween for pinching and conveying a recording material bearing an image thereon; and control means for controlling a power supply to said heating member, wherein said control means controls power to heat the nip after a fixing process is finished and a rotation of said back-up roller is stopped, and then said control means controls power to shut off the power supply to said heating member during a stand-by period.

2. An image fixing apparatus according to claim 1, wherein said control means heats the nip up to a temperature not less than a toner softening point after the rotation of said back-up roller is stopped.

3. An image fixing apparatus according to claim 1, wherein said control means heats the nip up to a temperature not less than a controlled temperature during the fixing process after the rotation of said back-up roller is stopped.

4. An image fixing apparatus according to claim 1, wherein said control means temperature-controls the nip with a predetermined temperature for a predetermined time period after the rotation of said back-up roller is stopped.

5. An image fixing apparatus according to claim 1, wherein, when the fixing process is started, said control means heats the nip after the rotation of said back-up roller is started.

6. An image fixing apparatus according to claim 5, wherein said control means sets a controlled temperature during the fixing process in accordance with the temperature of the nip before the nip is heated and after the rotation of said back-up roller is started.

7. An image fixing apparatus according to claim 6, wherein, when the temperature of the nip is lower than a predetermined temperature before the rotation of said back-up roller is started, said control means sets the controlled temperature during the fixing process in accordance with that temperature of the nip.

8. An image fixing apparatus according to claim 1, wherein, in a waiting condition in which the fixing process is not effected, said control means performs alternately heating of the nip during the stoppage of said back-up roller and the rotation of said back-up roller after the temperature is lowered.

9. A fixing apparatus comprising:

a heater having a temperature maintained to a temperature control temperature during a fixing process;

a film rotating while contacting with said heater;

a pressing roller forming a nip with said heater via said film; and said apparatus heating and fixing a toner image on a recording material while pinching and conveying the recording material, control means for generating heat in said heater so that a temperature of the nip becomes temporarily not less than a softening point of the toner after the fixing process is finished;

the temperature of the nip in this case being set in accordance with a warming condition of said pressing roller.

10. A fixing apparatus according to claim 9, wherein the temperature of the nip during the heat generating control is set in accordance with the warming condition of said pressing roller before said heater is risen-up to the temperature control temperature in the fixing process.

11. A fixing apparatus according to claim 10, wherein the warming condition of said pressing roller is judged on the basis of the temperature of said heater.

12. A fixing apparatus according to claim 9, wherein the temperature of the nip during the heat generating control is set in accordance with the temperature control temperature during the fixing process.

13. A fixing apparatus according to claim 9, wherein the temperature of the nip is judged on the basis of the temperature of said heater.

14. A fixing apparatus comprising:

a heater;

a fixing roller being heated by said heater and having a temperature maintained to a temperature control temperature during a fixing process;

a pressing roller forming a nip with said fixing roller; and said apparatus heating and fixing a toner image on a recording material while pinching and conveying the recording material, control means for generating heat in said heater so that a temperature of the nip becomes temporarily not less than a softening point of the toner after the fixing process is finished;

the temperature of the nip in this case being set in accordance with a warming condition of said pressing roller.

15. A fixing apparatus according to claim 14, wherein the temperature of the nip during the heat generating control is set in accordance with the warming condition of said pressing roller before said heater is risen-up to the temperature control temperature in the fixing process.

16. A fixing apparatus according to claim 15, wherein the warming condition of said pressing roller is judged on the basis of the temperature of said heater.

17. A fixing apparatus according to claim 14, wherein the temperature of the nip during the heat generating control is set in accordance with the temperature control temperature during the fixing process.

18. A fixing apparatus according to claim 14, wherein the temperature of the nip is judged on the basis of the temperature of said heater.

* * * * *

UNITED STATES PATENT AND TRADEMARK OFFICE

CERTIFICATE OF CORRECTION

PATENT NO. : 6,175,699 B1
DATED : January 16, 2001
INVENTOR(S) : Akira Kato, et al.

It is certified that error appears in the above-identified patent and that said Letters Patent is hereby corrected as shown below:

Column 1,
Line 51, "eat" should read -- heat --.

Column 13,
Line 60, "every" should read -- even --.

Signed and Sealed this

Thirtieth Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,175,699 B1
DATED : January 16, 2001
INVENTOR(S) : Akira Kato, et al.

It is certified that error appears in the above-identified patent and that said Letters Patent is hereby corrected as shown below:

Title page,
Item [30], Foreign Application Priority Data: "Oct. 30, 1998 (JP) .... 10-298156" should read -- Oct. 20, 1998 (JP) .... 10-298156. --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*